US009003822B2

(12) United States Patent
Lawson et al.

(10) Patent No.: US 9,003,822 B2
(45) Date of Patent: Apr. 14, 2015

(54) APPARATUS FOR BREAKING ICE CLUMPS

(75) Inventors: Wayne E. Lawson, LaGrange, KY (US); Daniel S. Renz, Louisville, KY (US); Arun Madhav Talegaonkar, Louisville, KY (US); Geoffrey Lee Ranard, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1223 days.

(21) Appl. No.: 12/853,829

(22) Filed: Aug. 10, 2010

(65) Prior Publication Data

US 2012/0036881 A1 Feb. 16, 2012

(51) Int. Cl.

| | |
|---|---|
| ***F25C 5/02*** | (2006.01) |
| ***F25C 5/18*** | (2006.01) |
| ***F25C 5/00*** | (2006.01) |
| ***F25C 5/04*** | (2006.01) |

(52) U.S. Cl.

CPC ..... *F25C 5/182* (2013.01); *F25C 5/005* (2013.01); *F25C 5/04* (2013.01)

(58) Field of Classification Search

USPC ..... 62/344, 342, 353, 354, 320, 66, 68; 241/98, 277

See application file for complete search history.

(56) References Cited

U.S. PATENT DOCUMENTS

| | | | | |
|---|---|---|---|---|
| 4,632,280 | A * | 12/1986 | Mawby et al. | 222/275 |
| 4,972,999 | A * | 11/1990 | Grace | 241/30 |
| 5,056,688 | A * | 10/1991 | Goetz et al. | 222/146.6 |
| 2006/0059939 | A1* | 3/2006 | An et al. | 62/344 |
| 2006/0202071 | A1* | 9/2006 | Jung et al. | 241/34 |
| 2008/0156016 | A1* | 7/2008 | Jeong et al. | 62/320 |
| 2008/0156826 | A1* | 7/2008 | Kim et al. | 221/258 |
| 2009/0133428 | A1* | 5/2009 | An et al. | 62/320 |

* cited by examiner

*Primary Examiner* — Mohammad M Ali
*Assistant Examiner* — Raheena Rehman
(74) *Attorney, Agent, or Firm* — GE Global Patent Operation; Douglas D. Zhang

(57) ABSTRACT

An apparatus for breaking ice clumps in a refrigerator. The apparatus includes an ice storage bin, an axle rotatably supported by an ice storage bin, an actuator operatively coupled to the axle and an ice breaker operatively coupled to the actuator. The ice breaker moves in a reciprocal manner upon the driving of the axle and the actuator. Such reciprocal movement of the ice breaker breaks ice clumps in the storage bin.

16 Claims, 12 Drawing Sheets

APPARATUS FOR BREAKING ICE CLUMPS

BACKGROUND OF THE INVENTION

The current disclosure relates generally to refrigerators, and more specifically, to an apparatus for breaking up ice clumps in an ice storage bin and a method of operating refrigerators to facilitate removal of the ice storage bin from the refrigerators.

Generally, a refrigerator includes an ice storage bin. The ice storage bin gets exposed to air of varying temperatures while ice is within the ice storage bin and can be removed from the refrigerator if desired. Typically ice within the ice storage bin experiences some melting and refreezing as it is exposed to varying temperatures within the ice storage bin. Over time the melting and re-freezing cycle can cause individual pieces of ice to join together, forming large clumps of ice which are too large to be dispensed from the ice storage bin and refrigerator. A typical ice storage bin and dispenser also include a spiral, rotating auger used to transport ice from the ice storage bin to where it is dispensed. This auger generally has insufficient structure to break up clumps of ice.

The refrigerator not having the ability to break up clumps of ice automatically has several disadvantages. One disadvantage is that when clumps of ice do form, they can block further dispensing of ice. Another disadvantage is that users must remove the ice storage bin and remove the clumps of ice themselves, which is inconvenient.

In addition, typically ice storage bins can be removed from the refrigerator if desired, without the removal of a motor which drives auger and/or ice crusher within the ice storage bin. The ice storage bin is typically coupled to the motor in a dual fork coupling arrangement with one fork being affixed to the motor and the other being affixed to the ice storage bin. This ice storage bin is typically secured to the refrigerator by tabs or latches which must be released before the ice storage bin can be removed from the refrigerator. Typically the fork affixed to the motor rotates in either direction based on input from a user, and can stop rotation whenever the input from the user ends. This stop in operation allows the forks to orient themselves in any random point along 360° of rotation. Once the forks have stopped rotating, if a portion of one fork is vertically above a portion of the other fork, removal of the ice storage bin by a user will be very difficult.

Removal of a typical ice storage bin can be difficult if the coupling forks orient themselves in certain positions.

Therefore, a refrigerator capable of breaking up ice clumps within an ice storage bin is desired for more efficient dispensing and handling of ice. Further, a method for removal of an ice storage bin with a dual fork coupling arrangement is desired.

BRIEF DESCRIPTION OF THE INVENTION

As described herein, the exemplary embodiments of the current invention overcome one or more of the above or other disadvantages known in the art.

One exemplary aspect of the present invention relates to an apparatus for breaking ice clumps. The apparatus includes a bin for storing ice cubes therein, an axle rotatably supported by the bin, an actuator operatively coupled to the axle to rotate upon driving of the axle, and an ice breaker operatively coupled to the actuator. The ice breaker is configured to move in a reciprocal manner upon rotation of the actuator, to break ice clumps formed by the ice cubes in the storage bin.

Another exemplary aspect of the present invention relates to a refrigerator. The refrigerator includes a compartment having an outlet for dispensing ice cubes, an ice maker disposed within the ice compartment for producing ice cubes upon stimulus, an apparatus disposed within the compartment, and a driving assembly. The apparatus includes a bin for storing ice cubes therein, an axle rotatably supported by the bin, an actuator operatively coupled to the axle to rotate upon driving of the axle, an ice breaker operatively coupled to the actuator and a coupler drivingly connected to the axle of the apparatus. The ice breaker is configured to move in a reciprocal manner upon rotation of the actuator, thereby breaking ice clumps formed by the ice cubes in the storage bin. The driving assembly includes a base member, a motor mounted to the base member and having a motor axle extending therefrom, and a motor fork operatively connected to the motor axle. The motor fork is configured to engage the coupler of the apparatus, thereby transmitting drive torque from the motor axle to the axle of the apparatus.

These and other aspects and advantages of the current invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
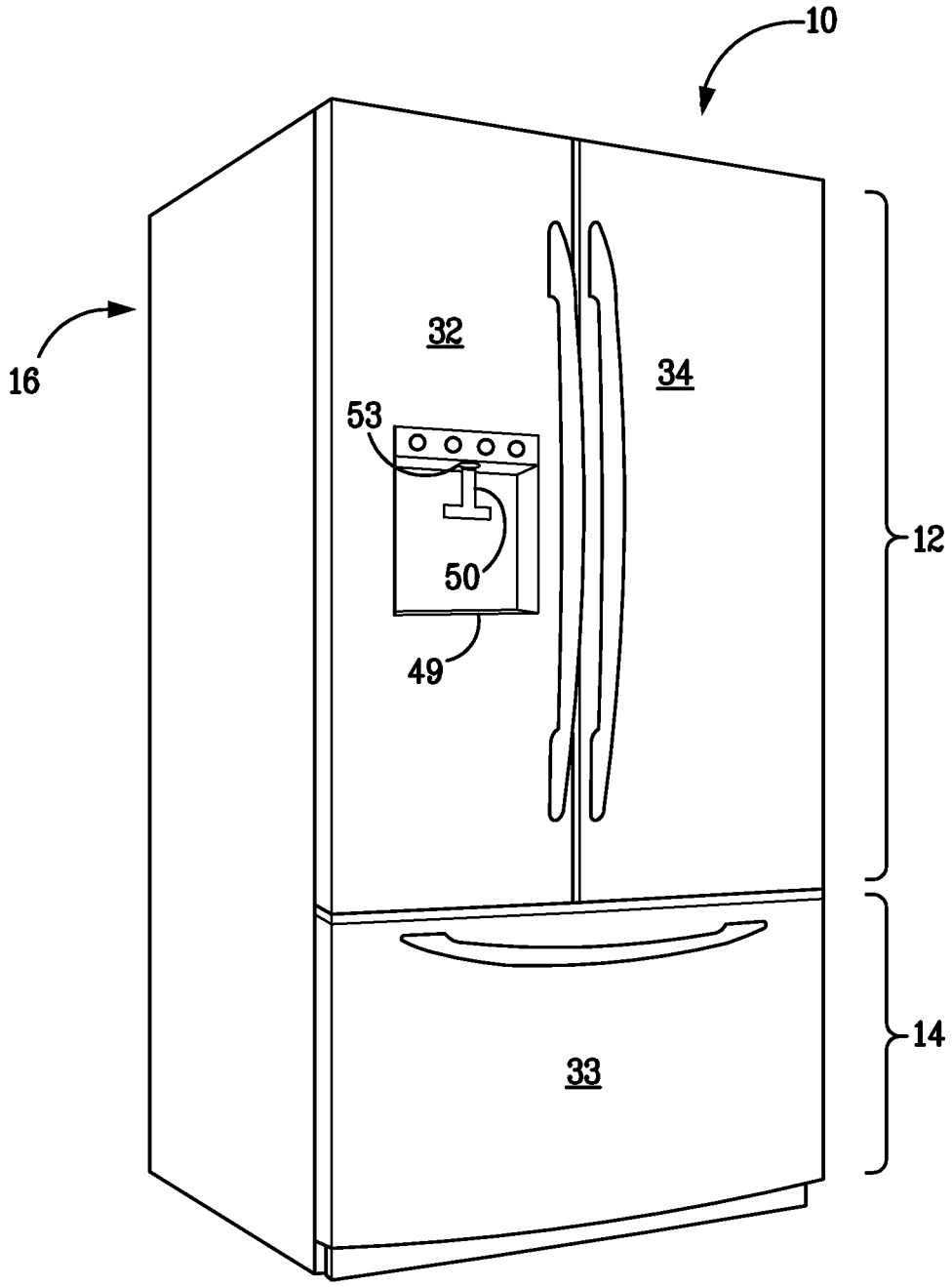
FIG. 1 is a perspective view of a refrigerator in accordance with an exemplary embodiment of the current invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to ice dispensing from the refrigerator, the description herein is for exemplary purposes only and is not intended to limit practice of the invention to a particular type of refrigeration appliance or machine, such as refrigerator 10.

On the exterior of the refrigerator 10, there is disposed an external access area 49 to receive ice cubes and/or drinking water. In response to a user's input, such as a stimulus for dispensing water, a water dispenser 50 allows an outflow of drinking water into a user's receptacle. In response to a user's input, such as a stimulus for dispensing ice, an ice dispenser outlet 53 of an ice making, storage and dispensing compartment 30 (shown in FIGS. 2 and 3) allows an outflow of whole ice cubes into a user's receptacle. In response to a user's input, such as another stimulus for dispensing ice, the ice dispenser outlet 53 can allow an outflow of crushed ice cubes or shaved ice into a user's receptacle. There are two access doors, 32 and 34, to the fresh food compartment 12, and one access door 33 to the freezer compartment 14. Refrigerator 10 is contained within an outer case 16.

Figure 2:
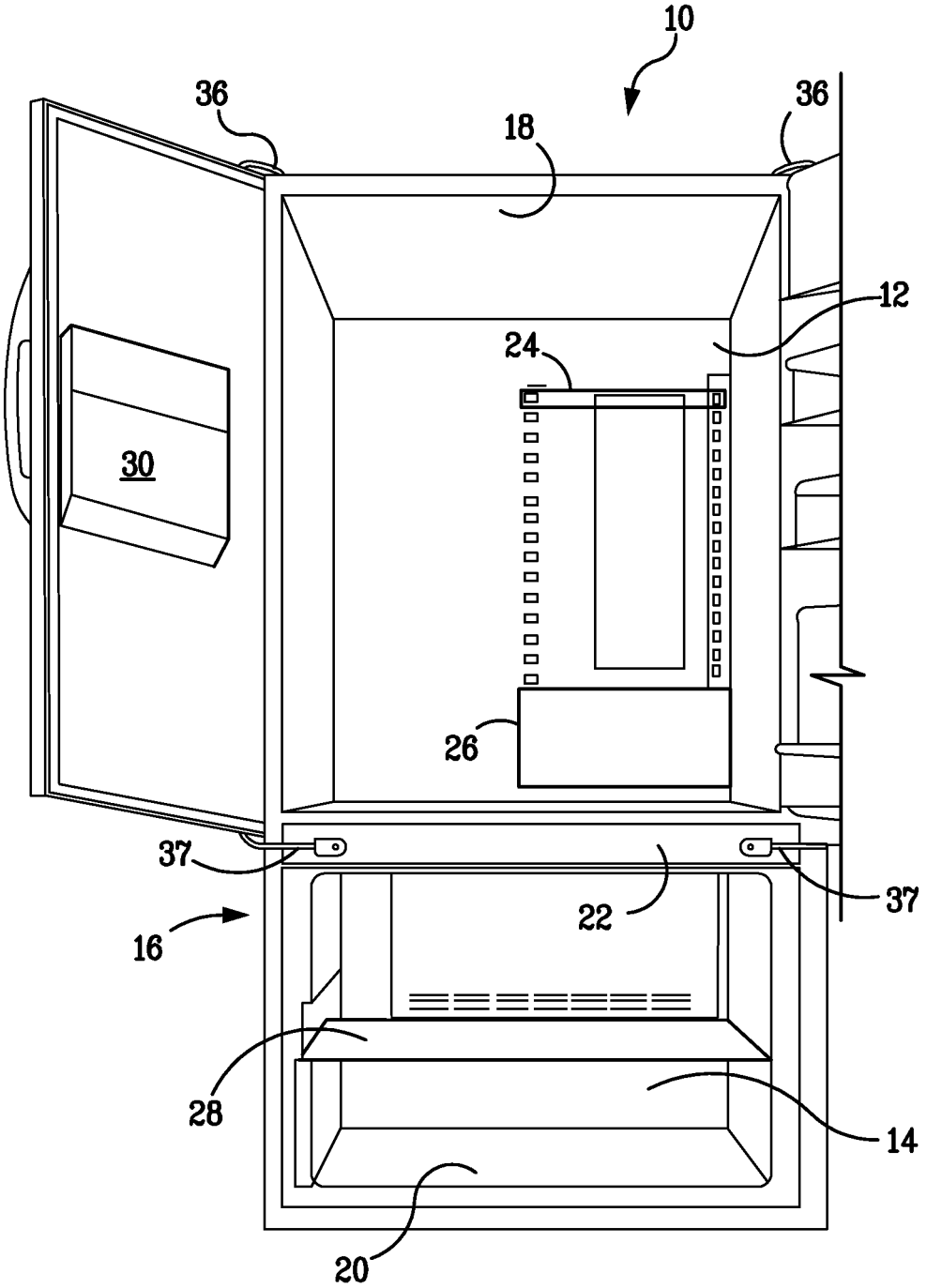
FIG. 2 is a perspective view of the refrigerator of FIG. 1 with the refrigerator doors being in an open position and the freezer door being removed for clarity.

FIG. 2 illustrates the refrigerator 10 with its upper access doors in the open position. Refrigerator 10 includes food storage compartments such as a fresh food compartment 12 and a freezer compartment 14. As shown, fresh food compartment 12 and freezer compartment 14 are arranged in a bottom mount refrigerator-freezer configuration. Refrigerator 10 includes outer case 16 and inner liners 18 and 20. A space between outer case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances.

The insulation in the space between liners 18, 20 is covered by another strip of suitable material, which is also commonly referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28, is provided in freezer compartment 14.

Left side fresh food compartment door 32, right side fresh food compartment door 34, and a freezer door 33 close access openings to fresh food compartment 12 and freezer compartment 14, respectively. In one embodiment, each of the doors 32, 34 are mounted by a top hinge assembly 36 and a bottom hinge assembly 37 to rotate about its outer vertical edge between a closed position, as shown in FIG. 1, and an open position, as shown in FIG. 2. The ice making, storage and dispensing compartment 30 can be seen on the interior of left side fresh food compartment door 32.

Figure 3:
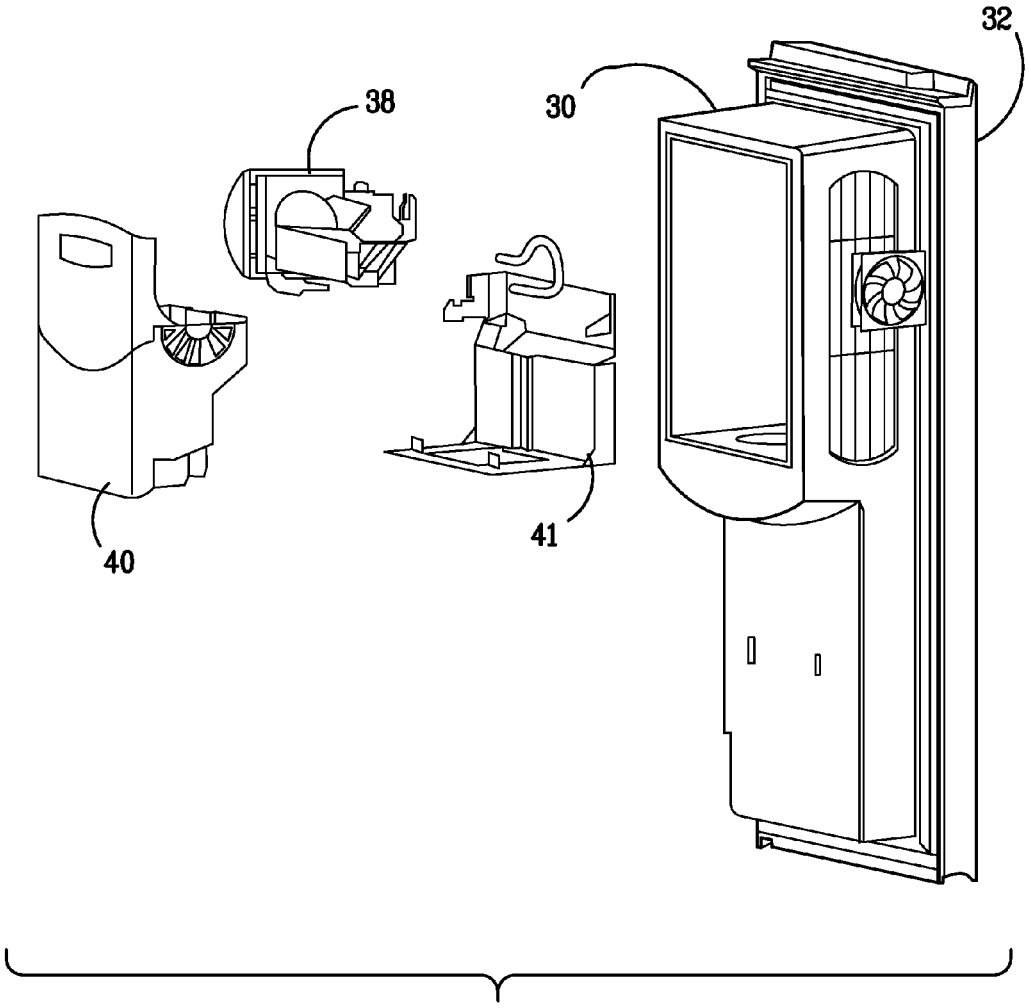
FIG. 3 is a partial exploded view of an exemplary refrigerator incorporating an ice clumps breaking apparatus on the interior of a left side fresh food compartment.

FIG. 3 is an exploded perspective view, showing an exemplary embodiment of an apparatus for breaking ice clumps, according to the present invention. The exemplary ice making, storage and dispensing compartment 30 is disposed on the interior of left side fresh food compartment door 32. An apparatus 40 for breaking ice clumps can be mounted into the compartment 30. A driving assembly 41, also disposed within the compartment 30, is drivingly engageable with the apparatus 40. For example, the driving assembly 41 has a motor for rotatably driving the apparatus 40. An electronic ice maker 38 can be disposed above the apparatus 40. The apparatus 40 can be removed and replaced into the ice making, storage and dispensing compartment 30 by a user for cleaning or other purposes.

Figure 4:
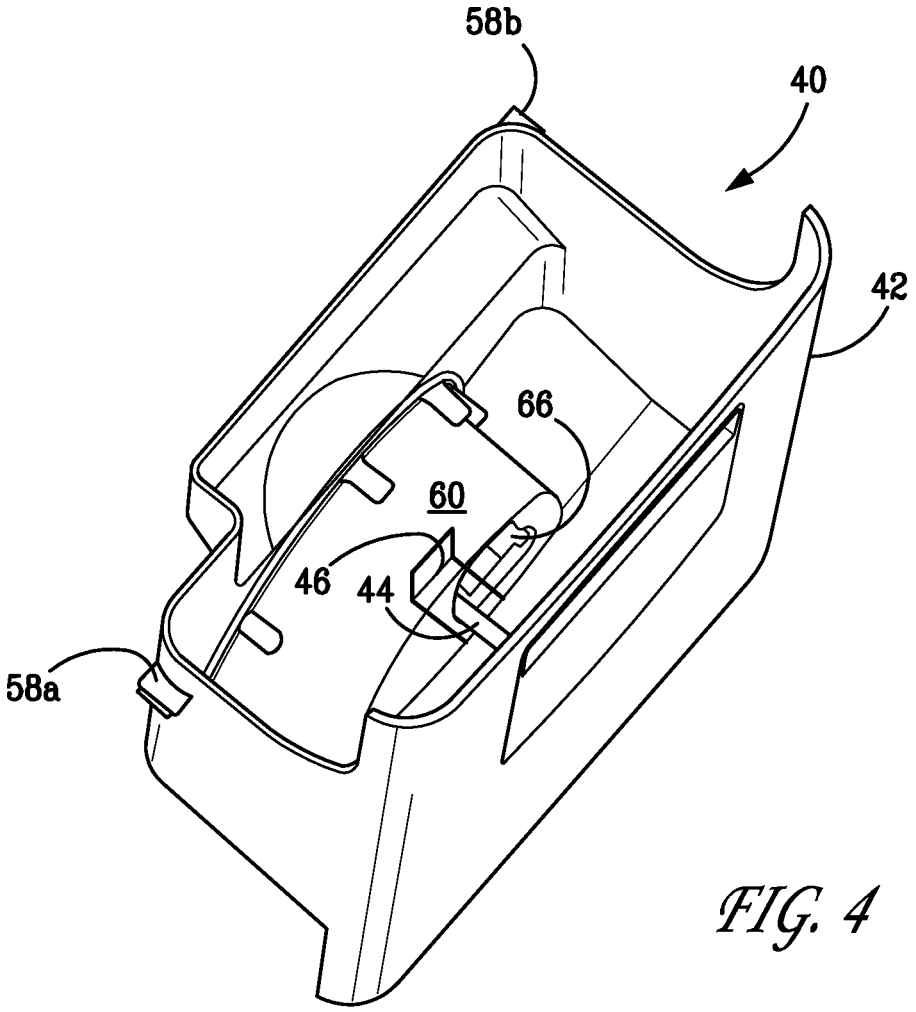
FIG. 4 is a perspective view of the ice clumps breaking apparatus.

FIG. 4 is a perspective view showing the exemplary apparatus 40 for breaking ice clumps. The apparatus 40 includes an ice storage bin 42, an axle 44 rotatably supported by the ice storage bin 42, an actuator 45 (shown in FIGS. 6-7C) operatively coupled to the axle 44 to rotate upon the driving of the axle 44, and an ice breaker 46 operatively coupled to the actuator 45 and disposed within the ice storage bin 42. The ice breaker 46 is configured to move in a reciprocal manner upon rotation of the actuator 45, to break ice clumps formed by the ice cubes in the ice storage bin 42.

The apparatus 40 further includes a housing 60 disposed within the ice storage bin 42. The housing 60 includes a front wall 56, a first opening 66 in the front wall 56, and a second opening (not shown) downstream of the first opening 66 such that ice can move from the first opening 66 to the second opening under gravity or action. Ice cubes of suitable sizes can pass through the first opening 66 ad move into an ice crushing area within the housing 60, where the ice cubes can be crushed or shaved by a set of blades under a user's input. The second opening is in communication with the outlet 53 of the compartment 30 to allow the crushed or shaved ice be dispensed through the outlet 53.

Figure 5:
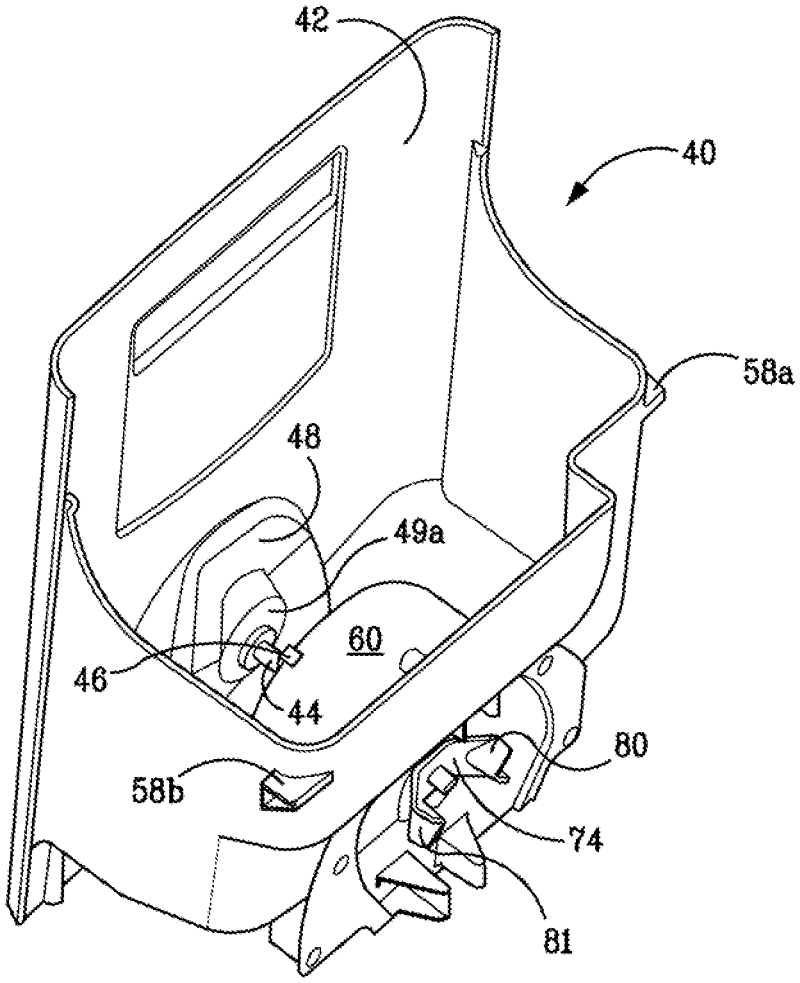
FIG. 5 is another perspective view of the apparatus.

FIG. 5 shows the apparatus 40 from a different perspective. As shown, the apparatus 40 can further include an agitator 48 disposed within the storage bin 42 substantially opposite to the first opening 66 of the housing 60. The agitator 48 is operatively coupled to the axle 44 and configured to rotate upon driving of the axle 44. For example, the agitator 48 can include at least one extension 49*a* with curved profile, for propelling ice cubes present in the ice storage bin 42 into the housing 60 through the first opening 66.

Ice cubes stored in the storage bin 42 may clump together if exposed repeatedly to warming and freezing cycles. In this case, the ice clumps formed from the ice cubes may stick to the ice storage bin 42 and/or become too big to enter the first opening 66. Thus, no ice can be delivered under a user's input. The ice breaker 46, according to the exemplary embodiment of the present invention, serves to break the ice clumps into ice pieces sufficiently small to pass through the first opening 66.

As shown in FIG. 5, the apparatus 40 further includes structures for mechanically engaging the driving assembly 41. For example, the apparatus 40 includes a pair of mating tabs 58*a* and 58*b* and a coupler 74, disposed externally of the ice storage bin 42. The mating tabs 58*a* and 58*b* are configured to releasably engage complementary mating structures of the driving assembly 41, which will be described later. The coupler 74 is secured to the axle 42 and configured to transfer the rotation of a motor of the driving assembly 41 to the axle 44 of the apparatus 40. For example, the coupler 74 can have two extensions 80 and 81 extending away from the surface of the coupler 74, which are configured to engage complementary structures of the motor so as to transfer the rotation of the motor to the axle 44.

Figure 6:
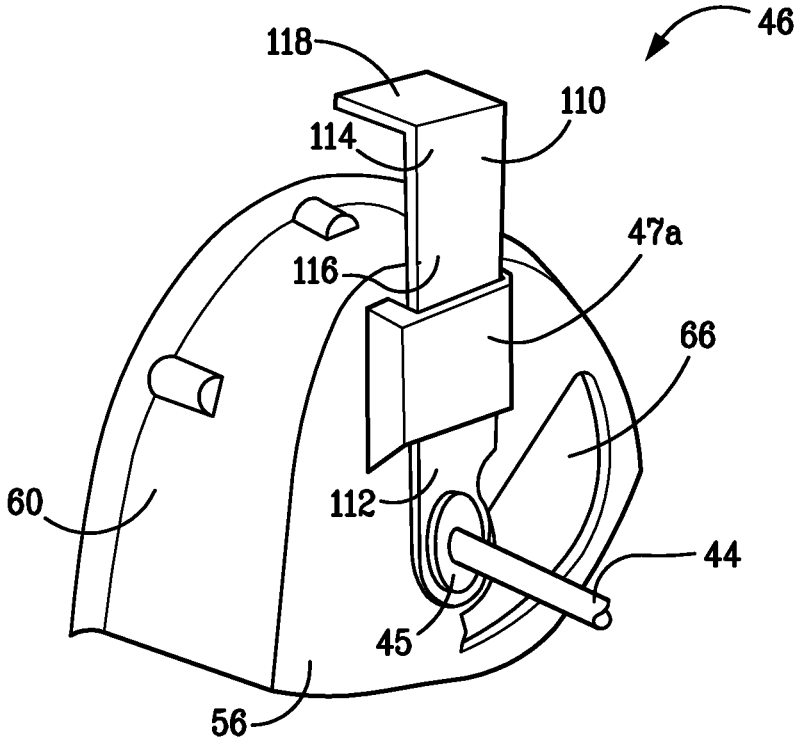
FIG. 6 is a partial perspective view of the apparatus.

FIG. 6 is a partial perspective view showing the apparatus 40 having the ice breaker 46 for breaking ice clumps. The ice breaker 46 is operatively coupled to the actuator 45. In the shown embodiment, the actuator 45 includes an eccentric cam affixed to the axle 44, so that as the axle 44 rotates in either direction, the off-center placement of the eccentric cam causes the ice breaker 46 to move reciprocally. As the axle 44 rotates, the ice breaker 46, with its reciprocal movement, exerts a force on clumps of ice which are present in the ice storage bin 42.

In this exemplary embodiment, the ice breaker 46 is disposed adjacent to the front wall 56 of the housing 60, and includes an elongated body 110 having a first end 112 and a second end 114 connected by a middle portion 116. The first end 112 is operatively connected to the actuator 45, and the second end 114 is disposed to extend beyond the housing 60. Optionally, the ice breaker 46 may further include a tip 118 extending angularly from the second end 114 and preferably above the housing 60. For example, the tip 118 of ice breaker 46 is shown as taking a 90° angle from the elongated body 110 of the ice breaker 46, but the tip 118 could be arranged in any suitable direction. The tip 118 is provided to enhance the ice breaking ability of the ice breaker 46. However, a person of ordinary skill in the art understands that any part of the ice breaker 46 can break clumps of ice present in the ice storage bin 42.

Figure 7A:
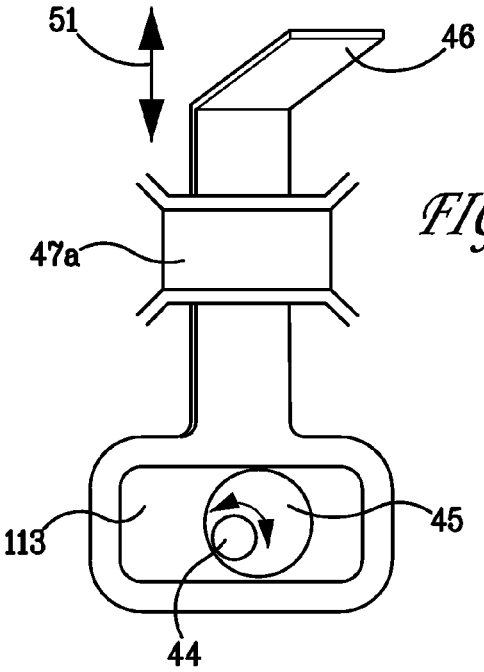
FIGS. 7A-7C are partial perspective views of an exemplary guide member of the apparatus.
Figure 7B:
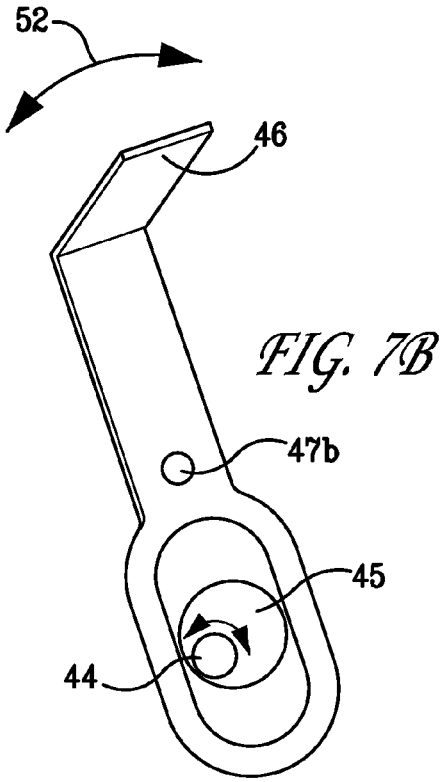
Figure 7C:
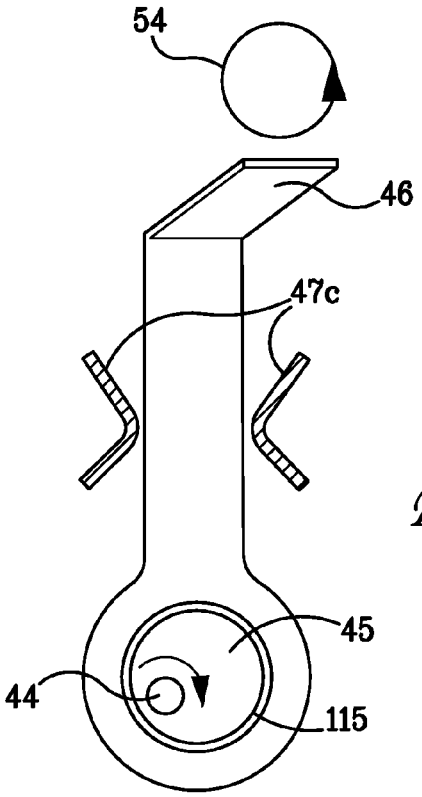

The apparatus 40 further includes an ice breaker guide 47*a* for guiding the ice breaker 46's movement. For example, the ice breaker guide 47*a*, in cooperation with the actuator 45 such as the eccentric cam, guides ice breaker 46 to move reciprocally in a desirable manner. FIGS. 7A-7C illustrates three exemplary embodiments of how the ice breaker 46 is guided and operated.

As shown in FIG. 7A, the ice breaker 46 includes a cavity 113, for example, a substantially rectangular cavity, disposed in the first end 112 of the elongated body 110. The eccentric cam 45 is operatively accommodated in the cavity 113. The ice breaker guide 47*a* is in the form of a band straddling over the middle portion 116 of the elongated body 110, so that the ice breaker 46 can translates upwardly and downwardly in a reciprocal manner under the guidance of the guide 47*a*, as represented by exemplary directional arrow 51. However, a person of ordinary skill in the art understands that the ice breaker guide 47*a* can also include other configurations for guiding the reciprocal translation of the ice breaker 46 along other directions.

FIG. 7B shows another exemplary embodiment of the ice breaker guide, identified by numeral reference 47*b*. The guide 47*b* is in the form of a pin fixed to the front wall 56 of the housing 60. The pin 47*b* extends through the middle portion 116 of the elongated body 117, to allow the second end 114 to pivot reciprocally upon rotation of the eccentric cam 45, along the direction represented by exemplary directional arrow 52.

FIG. 7C shows another exemplary embodiment of the ice breaker guide, identified by numeral reference 47*c*. The guide 47*c* is in the form of a pair of brackets secured to the front wall 56 of the housing 60. The brackets 47*c* are disposed at either side of the middle portion 116 of the elongated body 110, respectively. In this embodiment, the ice breaker 46 includes a cavity 115, provided in the first end 112 of the elongated body 110, which has an inner profile substantially complementary to the outer profile of the eccentric cam 45. When the eccentric cam 45 rotates under the driving of the axle 44, the pair of brackets 47*c* cooperatively engage the middle portion 116 of the ice breaker 46, to allow the second end 114 of the ice breaker 46 to move in a substantially circular fashion, as represented by exemplary directional arrow 54.

If large clumps of ice are formed within the ice storage bin 42, clumps which may be too large to fit through the first housing opening 66 or too large to be dispensed to a user, typically stop all flow of ice. Referring again to FIG. 4, when a user inputs a stimulus requesting ice, the axle 44 rotates and facilitates the movement of whole ice cubes within the ice storage bin 42, through the first housing opening 66 and into a user's receptacle. At the same time, the ice breaker 46 also is moved as the axle 44 rotates as described in the examples above and shown in FIGS. 7A-7C. As the ice breaker 46 is moved, it contacts clumps of ice and breaks up the clumps of ice to a sufficiently small size, so that the broken clumps of ice can pass through the first housing opening 66 and can be dispensed to a user.

Figure 8A:
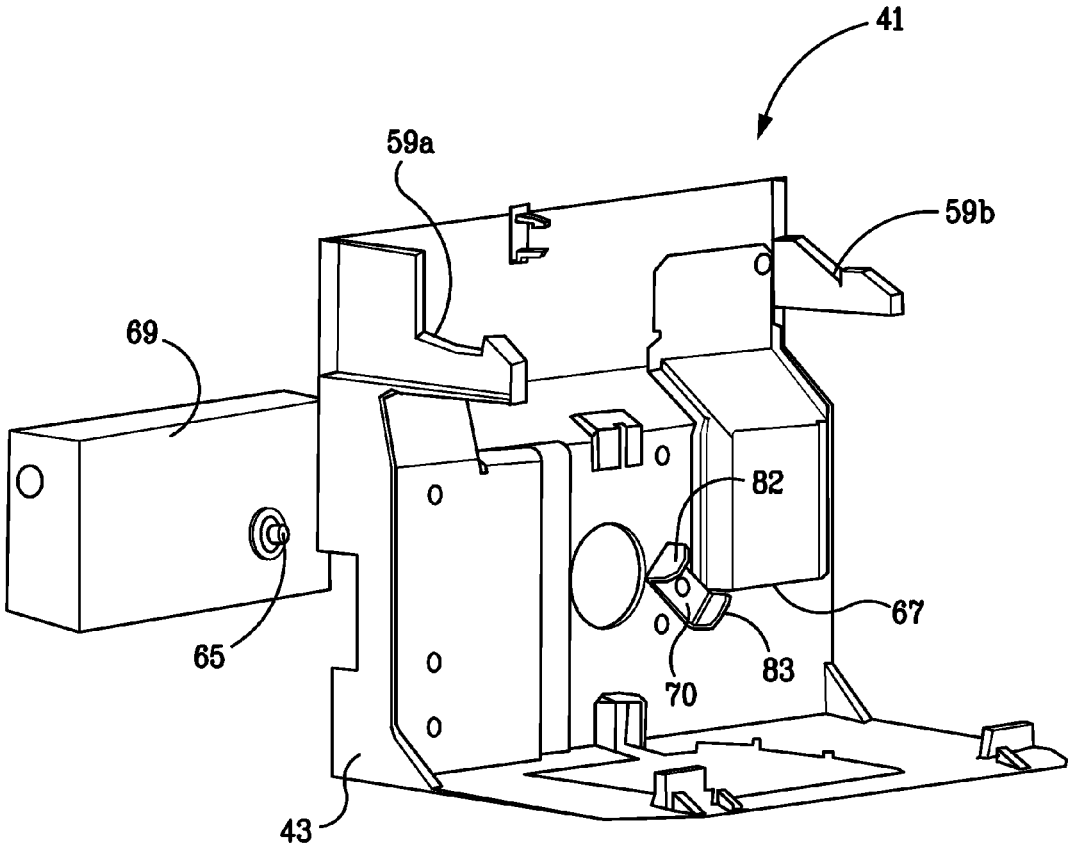
FIGS. 8A and 8B are perspective views of a driving assembly of the exemplary refrigerator.

FIG. 8A shows an exploded perspective view of the driving assembly 41, which drives the ice breaker 46 as well as the set of blades in the ice crushing area of the housing 60. The driving assembly 41 includes a base member 43 and a motor 69 which can be mounted to the base member 43. The motor 69 includes a motor axle 65 extending from the motor 69 and through an opening of the base member 43. The driving assembly 41 further includes a motor fork 70, which is disposes on the opposite side of the base member 43, with respect to the motor 69. The motor fork 70 is fixedly secured to the motor axle 65 through a securer 67. In this embodiment, the motor securer 67 is shown as a threaded nut but could be any means for securing motor fork 70 to motor axle 65. The motor fork 70 is configured to engage the coupler 74 of the apparatus 40, thereby transferring the drive torque of the motor axle 65 to the axle 44 of the apparatus 40. The motor fork 70 can include a pair of extensions 82 and 83, which engage the pair of extensions 80 and 81 (shown in FIG. 5) of the coupler 74, respectively. The driving assembly 41 further includes a pair of mating latches 59*a* and 59*b*, which are configured to releasably engage the mating tabs 58*a* and 58*b* (shown in FIG. 5) of the apparatus 40.

Figure 8B:
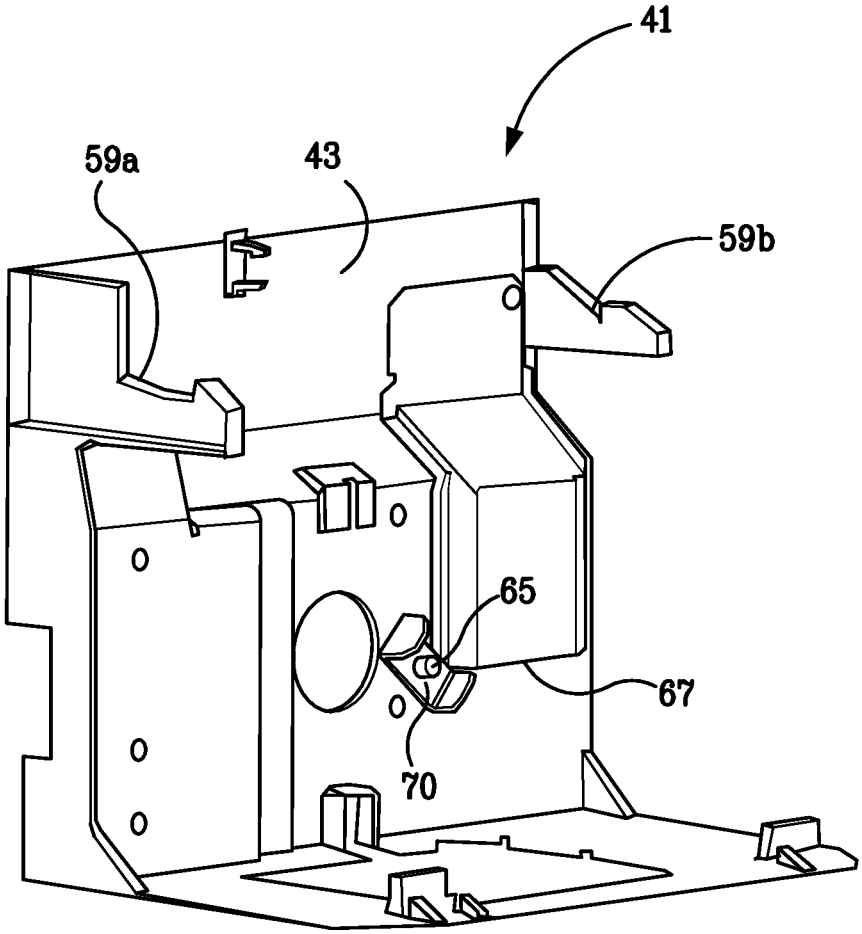

The driving assembly 41 in a compact form is shown in FIG. 8B. During operation, the driving assembly 41 is first installed in the compartment 30, for example, on the interior of left side fresh food compartment door 32. Subsequently, the apparatus 40 is mechanically attached to the driving assembly 41 through the engagement between the mating tabs 58*a* and 58*b* of the apparatus 40 and the mating latches 59*a* and 59*b* of the driving assembly 41. At the same time, the apparatus 40 is drivingly connected to the driving assembly 41 through the engagement between the extensions 80 and 81 of the coupler 74 and the extensions 82 and 83 of the motor fork 70. Once the apparatus 40 and the driving assembly 41 are mechanically and operatively connected to each other, sealing material can be applied to place them in the compartment 30 in a sealed manner.

Figure 9:
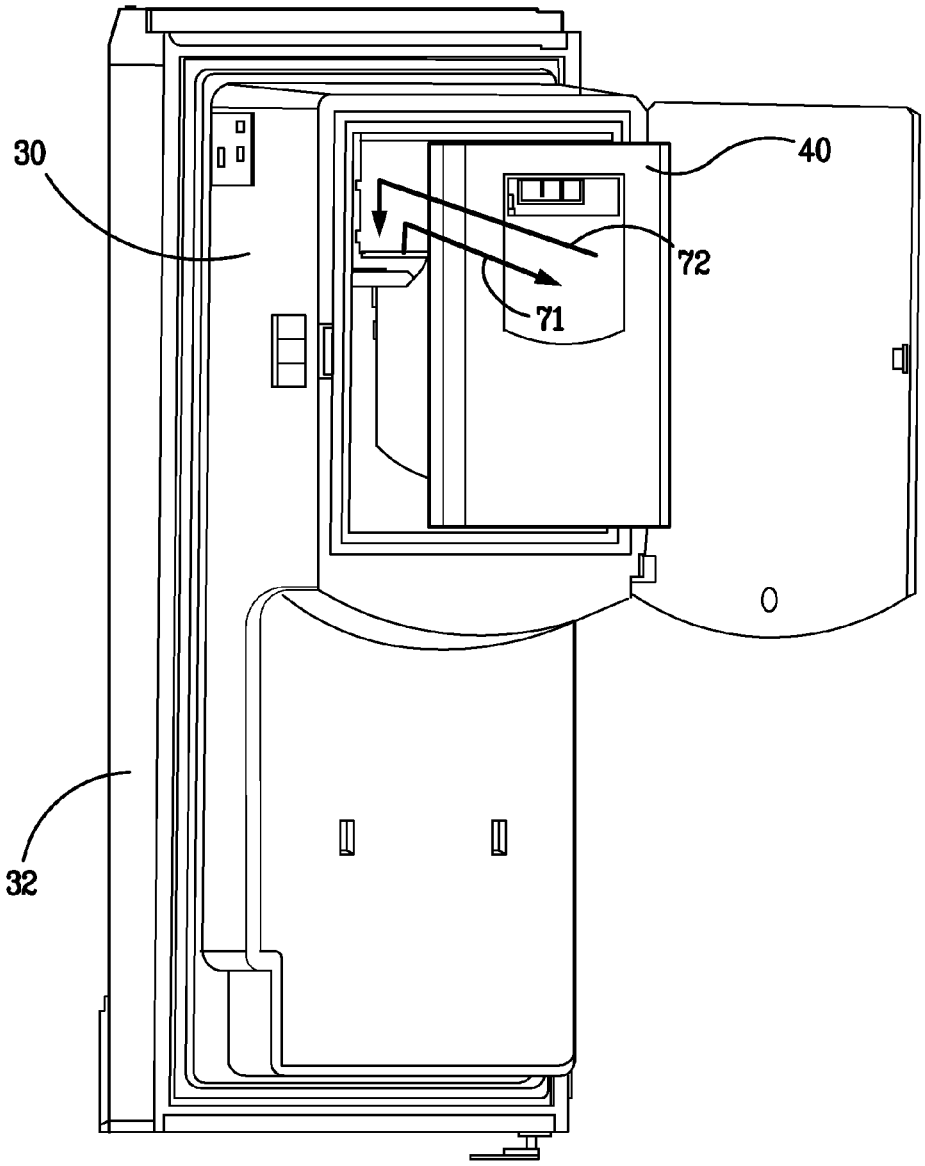
FIG. 9 is a partial perspective view of the refrigerator, showing assembly and removal of the apparatus with respect to the refrigerator.

FIG. 9 shows the process for attaching the ice clumps breaking apparatus 40 to the driving assembly 41 and removing the apparatus 40 from the driving assembly 41. As shown, for a user to attach the apparatus 40, the user slides the ice storage bin 42 into the compartment 30 and vertically down so that the tabs 58*a* and 58*b* catch the latches 59*a* and 59*b* respectively. The movement to attach the apparatus 40 is represented by an ice storage bin insertion arrow 72. For a user to remove the apparatus 40, the user lifts the ice storage bin 42 vertically upwards, and subsequently slides the ice storage bin 42 out of the compartment 30 so that the tabs 58*a* and 58*b* move above the edge of the tab latches 59*a* and 59*b*. The movement to remove the apparatus 40 is represented by an ice storage bin removal arrow 71.

Figure 10A:
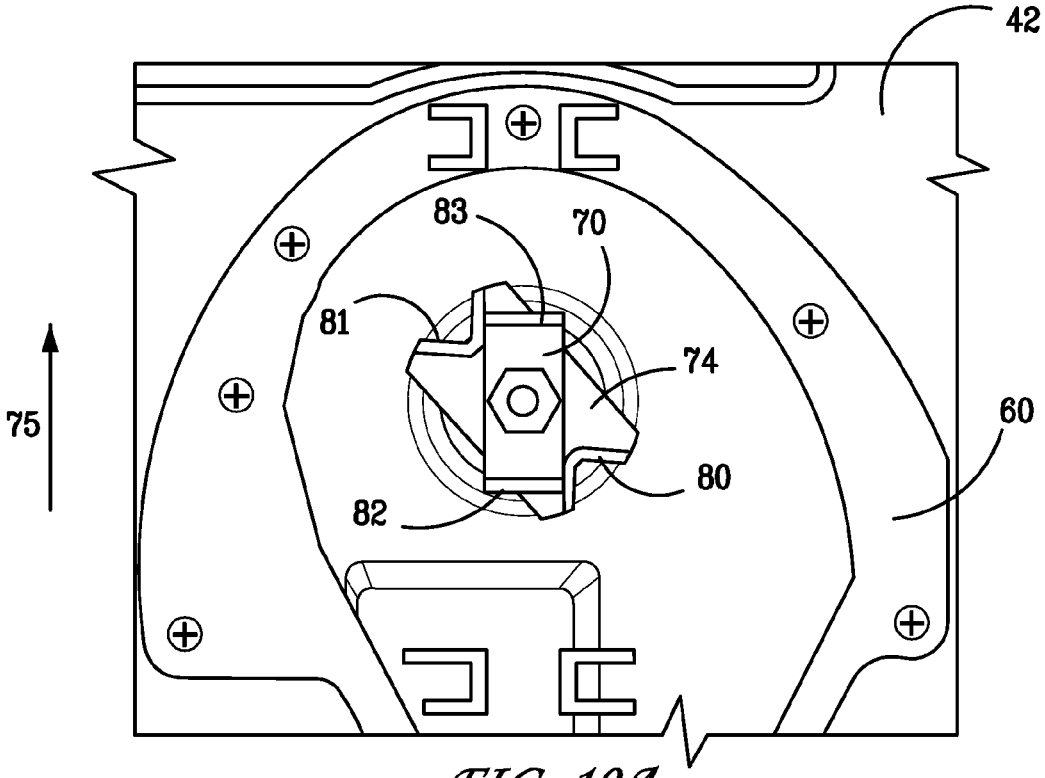
FIGS. 10A and 10B are schematic views, showing the interaction between a coupler of the apparatus and a motor fork of the driving assembly.
Figure 10B:
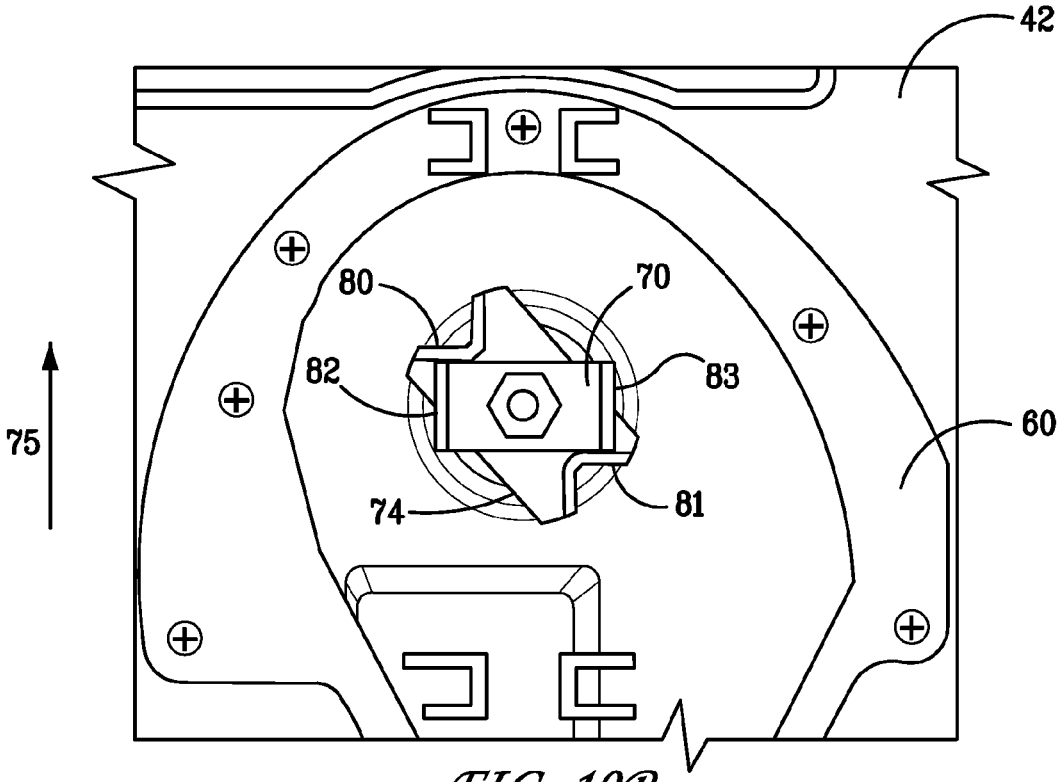

Attachment and removal of the apparatus 40 with respect to the driving assembly 41 can occur, as long as the coupler 74 of the apparatus 40 and the motor fork 70 of the driving assembly 41 are properly aligned to each other. FIGS. 10A and 10B are views of the interaction between the coupler 74 of the apparatus 40 and motor fork 70 of the driving assembly 41 as viewed from the motor 69, looking at the exterior of the ice storage bin 42. FIGS. 10A and 10B show the interaction of ice storage bin coupler 74 and motor fork 70, such that they contact each other upon rotation.

The motor fork extensions 82 and 83 of the motor fork 70 interact with the extensions 80 and 81 of the coupler 74 respectively, so that when the motor 69 rotates, motor fork extensions 82 and 83 contact and cause the coupler extensions 80 and 81 to rotate accordingly.

In the orientation shown in FIG. 10A, if a user were to remove ice storage bin 42, the coupler 74 could vertically pass the motor fork 70, as shown by an exemplary removal direction arrow 75, without either of the sections of the coupler 74 and motor fork 70 getting stuck or obstructing each other. In the orientation shown in FIG. 10B, if a user were to attempt to remove the ice storage bin 42, in the direction of the exemplary removal direction arrow 75, the motor fork extension 82 would interfere the coupler extension 80, preventing the removal of ice storage bin 42.

During operation, the coupler 74 and the motor fork 70 may end their rotation at any orientation in reference to each other, depending on the random time a user causes the motor 69 to stop rotating. The orientations shown in FIGS. 10A and 10B are two examples of the orientation of the coupler 74 and the motor fork 70 after they stop rotating. The motor 69 can cause the coupler 74 and the motor fork 70 to rotate in either a clockwise or counter-clockwise direction based on an input by a user.

According to another exemplary aspect of the present invention, a method of operating a refrigerator is provided. The exemplary method ensures that the removal of the ice storage bin 40 can occur by ensuring that the extensions 80 and 81 of the ice storage bin coupler 74 and the extensions 82 and 83 of the motor fork 70 do not stop rotation at an orientation where the extensions would interfere with each other, such as the one shown in FIG. 10B.

The exemplary method includes contacting the motor fork 70 of the driving assembly 41 of the refrigerator with the coupler 74 of the ice clumps breaking apparatus 40 of the refrigerator; rotating the motor fork 70 in a first direction based on a user's input; and rotating the motor fork 70 in a second direction, opposite to the first direction, for a predetermined time or angle after an end of the user's input.

Figure 11:
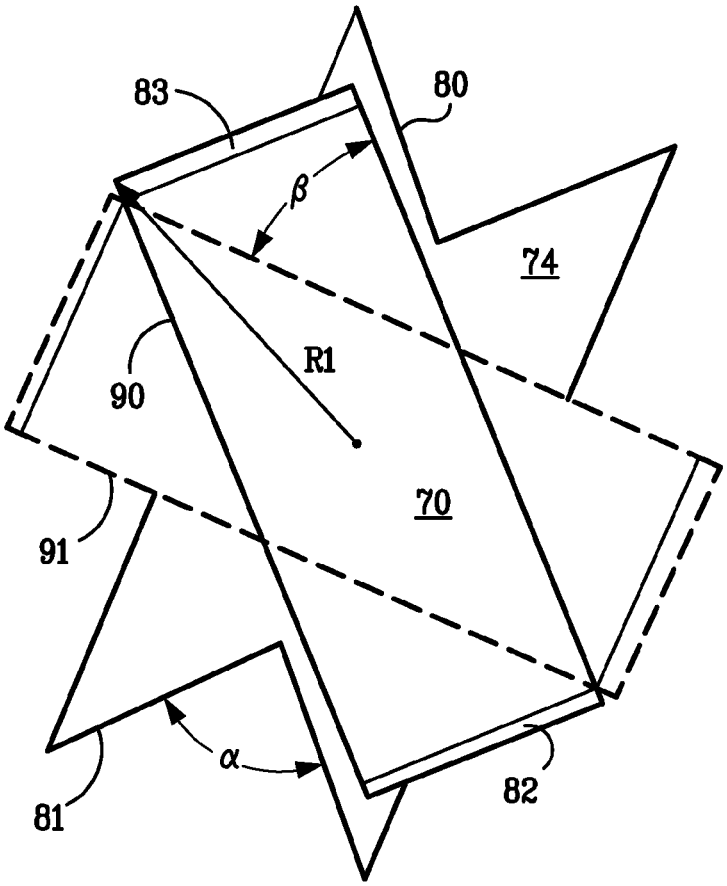
FIG. 11 is a graphical representation of the coupler and the motor fork, showing a method of operating the refrigerator to ensuring smooth assembly and removal of the apparatus with respect to the driving assembly, according to another exemplary aspect of the present invention.

FIG. 11 is a graphical representation of the coupler 74, the coupler extensions 80 and 81, the motor fork 70, and the motor fork extensions 82 and 83. In this graphical representation, the coupler extensions 80 and 81 would be extending out of the page towards the motor fork 70 while the motor fork extensions 82 and 83 would be extending into the page, towards the coupler 74. The motor fork 70 rotates in either direction, based on input by a user. For example, if a user wants whole ice cubes, the motor fork 70 rotates in a first, clockwise direction, and if a user wants shaved or crushed ice cubes, the motor fork 70 rotates in a second, counter-clockwise direction.

In order to ensure that the extensions of the coupler 74 and the motor fork 70 do not stop rotation vertically above each other and removal of the ice storage bin 42 can be achieved, the motor 69 rotates in a direction opposite to the direction it was rotating to dispense ice for a predetermined time or angle.

For example, if the motor fork 70 stops rotation in position 90, as shown by the solid lines in FIG. 11, and the motor fork 70 has been rotating in a clockwise direction, the motor 69 will rotate the motor fork 70 in a second, counter-clockwise direction for a predetermined time or angle so that the motor fork will rest in position 91, as shown by the dashed lines in FIG. 11. In another example, if the motor fork 70 is being rotated in a counter-clockwise direction to dispense ice, the motor 69 will rotate the motor fork 70 in the clockwise direction for a predetermined time or angle after the user ends his or her input to dispense ice.

The predetermined time or angle is sufficient to allow for a clearance between the coupler extensions 80 and 81 and the motor fork extensions 82 and 83. The predetermined time or angle would be set to allow the motor fork 70 to rotate counter wise so that it would not contact the coupler extensions 80, 81. For example, the predetermined time or angle can be set to allow the motor fork 70 to rotate counter wise so that it would be halfway to contacting the opposite coupler extensions 80, 81. In the example shown in FIG. 11, at the end of rotation to dispense ice, the motor fork extension 83 is contacting the coupler extension 80. The motor fork 70 would then rotate in the counter-clockwise direction to position 91, which would be roughly halfway to the motor fork extension 83 contacting the coupler extension 82. This method ensures that whichever orientation the motor fork 70 and the coupler 74 obtain after rotation to dispense ice, the extensions of the motor fork 70 and the coupler 74 will not block the removal of the ice storage bin 42.

In the exemplary embodiment shown in FIG. 11, the rotational radius R1 of the motor fork 70 is 0.75", and the angle $\alpha$ between the two prongs of the extension 80 or 81 of the coupler 74 is about 88°. Furthermore, the motor fork 70 and the coupler 74 are dimensioned so that, when the motor fork 70 rotates halfway between the extensions 80 and 81 of the coupler 74, a clearance of 0.25" is provided between the motor fork 70 and the coupler 74, which is sufficient to lift the ice storage bin 42 to remove the ice storage bin 42. Accordingly, in this exemplary embodiment, the predetermined angle $\beta$ for rotating the motor fork 70 is about 46° (90°-88°/2). Since the motor 69 rotates 25 RPM at no load, the predetermined time for rotating the motor fork 70 is about 0.31 seconds.

However, a person of ordinary skill in the art understands that the predetermined time or angle for rotating the motor fork changes as the angle $\alpha$ and/or the rotating speed of the motor change. In addition, the necessary clearance for lifting the ice storage bin 42 changes as the dimensions of the motor fork and the coupler change. Accordingly, without departing from the spirit of the above aspect of the present invention, the person is able to make necessary adjustments to the predetermined time or angle considering the above factors, to ensure that the coupler and the motor fork do not interfere with each other.

Figure 12:
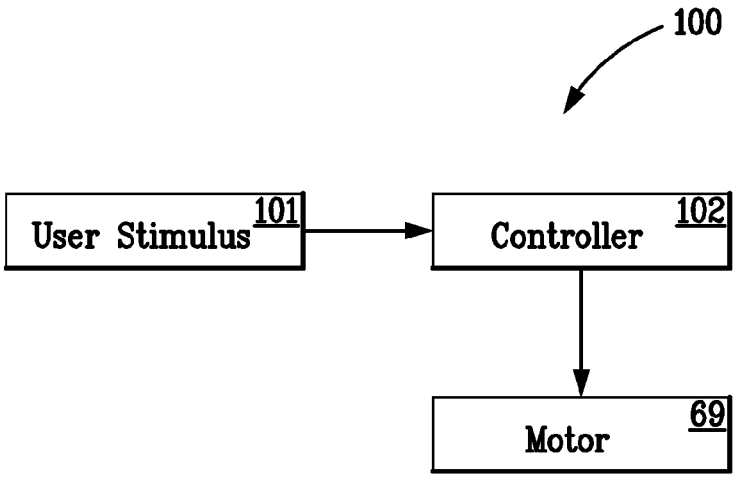
FIG. 12 is a block diagram of an exemplary ice dispenser control system.

FIG. 12 is a block diagram of an exemplary ice dispenser control system 100. The ice dispenser control system 100 includes the motor 69, a controller 102 and a user stimulus 101. The method of controlling the motor 69 based on the user stimulus 101 is inputted into the controller 102, for example, by programming into memory of an application specific integrated circuit (ASIC) or other programmable memory device. Both predetermined time and angle, which the motor 69 rotates in the direction opposite to the direction it was rotating to dispense ice, can be programmed into the controller 102.

The controller 102 controls the operation of the motor 69 based on the user stimulus 101. If a user stimulus 101 occurs, causing the motor 69 to rotate either clockwise or counter-clockwise, the controller 102 will then cause the motor 69 to rotate in the opposite direction for a predetermined time or angle after the user stimulus 101 ends. This predetermined time or angle can be programmed into the memory of the controller 102.

An ice dispenser assembly is provided which provides for the dispensing of ice and the removal of an ice storage bin in an efficient and reliable manner. Ice dispensing efficiency is increased through the breaking of ice clumps by the ice breaker. Ice storage bin removal is also enhanced and provides a method which ensures that removal can occur easily and the ice storage bin coupler and motor fork will not hinder removal of the ice storage bin.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a bin for storing ice cubes therein;

an axle rotatably supported by the bin;

an actuator operatively coupled to the axle to rotate upon driving of the axle;

a housing disposed within the bin, the housing having an ice crushing area between a first opening and a second opening downstream of the first opening, to allow the ice cubes to move from the first opening into the ice crushing area, and on to the second opening under gravity or action;

an ice breaker operatively coupled to the actuator and disposed outside of the housing in the bin, the ice breaker being configured to move in a reciprocal manner upon rotation of the actuator, thereby breaking ice clumps outside of the housing in the bin; and an agitator disposed within the bin oppositely to the first opening of the housing and operatively coupled to the axle, the agitator being configured to rotate upon driving of the axle, thereby propelling the ice cubes in the bin into the housing through the first opening of the housing.

2. The apparatus according to claim 1, further comprising an ice breaker guide disposed within the bin and operatively coupled to the ice breaker, for guiding the reciprocal movement of the ice breaker.

3. The apparatus according to claim 2, wherein the ice breaker comprises an elongated body having a first end and a second end connected by a middle portion, the first end operatively coupled with the actuator and the second end extending beyond the housing.

4. The apparatus according to claim 3, wherein the ice breaker further comprises a tip extending angularly from the second end of the elongated body.

5. The apparatus according to claim 3, wherein:

the first end of the ice breaker has a cavity therein; and the actuator comprises an eccentric cam operatively accommodated in the cavity, rotation of the eccentric cam moving the ice breaker in the reciprocal manner.

6. The apparatus according to claim 5, wherein the ice breaker guide comprises a band straddling the middle portion of the ice breaker, to allow the ice breaker to translate reciprocally upon rotation of the eccentric cam.

7. The apparatus according to claim 5, wherein the ice breaker guide comprises a pin extending through the middle portion of the ice breaker, to allow the second end of the ice breaker to pivot reciprocally upon rotation of the eccentric cam.

8. The apparatus according to claim 5, wherein the ice breaker guide comprises a pair of brackets disposed at either side of the middle portion of the ice breaker, to allow the second end of the ice breaker to circulate reciprocally upon rotation of the eccentric cam.

9. The apparatus according to claim 1, further comprising a coupler disposed externally of the bin and drivingly connected to the axle, the coupler configured to engage a motor of a refrigerator.

10. A refrigerator comprising:

a compartment having an outlet for dispensing ice cubes;

an ice maker disposed within the compartment for producing the ice cubes upon a stimulus;

an apparatus disposed within the compartment, comprising:

a bin for storing the ice cubes produced by the ice maker, an axle rotatably supported by the bin, an actuator operatively coupled to the axle to rotate upon driving of the axle, a housing disposed within the bin, the housing having an ice crushing area between a first opening and a second opening downstream of the first opening, the second opening in communication with the outlet of the compartment to allow the ice cubes to move from the first opening into the ice crushing area, and on to the outlet under gravity or action, an ice breaker operatively coupled to the actuator and disposed outside of the housing in the bin, the ice breaker configured to move in a reciprocal manner upon rotation of the actuator, thereby breaking ice clumps outside of the housing in the bin, an agitator disposed within the bin oppositely to the first opening of the housing and operatively coupled to the axle, the agitator being configured to rotate upon driving of the axle, thereby propelling the ice cubes in the bin into the housing through the first opening of the housing, and a coupler drivingly connected to the axle; and a driving assembly comprising:

a base member, a motor mounted to the base member, the motor having a motor axle extending therefrom, and a motor fork operatively connected to the motor axle and configured to engage the coupler of the apparatus, thereby transmitting drive torque from the motor axle to the axle of the apparatus.

11. The refrigerator according to claim 10, wherein the apparatus further comprises an ice breaker guide disposed within the bin and operatively coupled to the ice breaker, for guiding the reciprocal movement of the ice breaker.

12. The refrigerator according to claim 11, wherein the ice breaker comprises an elongated body having a first end and a second end connected by a middle portion, the first end operatively coupled with the actuator and the second end extending beyond the housing, the ice breaker further comprising a tip extending angularly from the second end of the elongated body.

13. The refrigerator according to claim 12, wherein:

the first end of the ice breaker has a cavity therein; and the actuator comprises an eccentric cam operatively accommodated in the cavity, rotation of the eccentric cam moving the ice breaker in the reciprocal manner.

14. The refrigerator according to claim 13, wherein the ice breaker guide comprises a band straddling the middle portion of the ice breaker, to allow the ice breaker to translate reciprocally upon rotation of the eccentric cam.

15. The refrigerator according to claim 13, wherein the ice breaker guide comprises a pin extending through the middle portion of the ice breaker, to allow the second end of the ice breaker to pivot reciprocally upon rotation of the eccentric cam.

16. The refrigerator according to claim 13, wherein the ice breaker guide comprises a pair of brackets disposed at either side of the middle portion of the ice breaker, to allow the second end of the ice breaker to circulate reciprocally upon rotation of the eccentric cam.

* * * * *